US007914334B2

(12) United States Patent
Foratier

(10) Patent No.: US 7,914,334 B2
(45) Date of Patent: Mar. 29, 2011

(54) ADAPTER HAVING FLEXIBLE CABLE

(75) Inventor: Nathalie Foratier, Saint Antoine L'Abbaye (FR)

(73) Assignees: LeGrand France, Limoges (FR); LeGrand SNC, Limoges (FR)

( * ) Notice: Subject to any disclaimer, the term of this patent is extended or adjusted under 35 U.S.C. 154(b) by 0 days.

(21) Appl. No.: 12/445,780

(22) PCT Filed: Oct. 17, 2007

(86) PCT No.: PCT/FR2007/001720
§ 371 (c)(1),
(2), (4) Date: Jan. 28, 2010

(87) PCT Pub. No.: WO2008/047005
PCT Pub. Date: Apr. 24, 2008

(65) Prior Publication Data

US 2010/0151739 A1 Jun. 17, 2010

(30) Foreign Application Priority Data

Oct. 20, 2006 (FR) ..... 06 09253

(51) Int. Cl.
*H01R 25/00* (2006.01)

(52) U.S. Cl. ..... 439/638

(58) Field of Classification Search ..... 439/638, 439/344, 632, 654, 736, 676, 655, 686, 687
See application file for complete search history.

(56) References Cited

U.S. PATENT DOCUMENTS

| | | | | | |
|---|---|---|---|---|---|
| 4,290,664 | A * | 9/1981 | Davis et al. | 439/638 |
| 4,367,908 | A | 1/1983 | Johnston | 339/154 A |
| 4,806,117 | A | 2/1989 | Johnston | 439/344 |
| 4,904,209 | A * | 2/1990 | Nelson | 439/676 |
| 5,044,981 | A * | 9/1991 | Suffi et al. | 439/533 |
| 5,080,609 | A * | 1/1992 | Fabian et al. | 439/541.5 |
| 5,265,322 | A * | 11/1993 | Fisher et al. | 29/848 |
| 5,267,876 | A * | 12/1993 | Rupert et al. | 439/541.5 |
| 5,391,095 | A * | 2/1995 | Born | 439/676 |
| 5,651,701 | A | 7/1997 | Chen | 439/607 |
| 6,031,909 | A * | 2/2000 | Daoud | 379/438 |
| 6,203,348 | B1 * | 3/2001 | Fukuda | 439/275 |
| 6,623,306 | B2 * | 9/2003 | Xu et al. | 439/676 |
| 2002/0151224 | A1 | 10/2002 | Liao | 439/676 |
| 2003/0199200 | A1 | 10/2003 | Chan | 439/638 |

FOREIGN PATENT DOCUMENTS

EP 1 458 062 A2 9/2004

OTHER PUBLICATIONS

International Search Report and Written Opinion from corresponding application No. PCT/FR2007/001720 dated Mar. 17, 2008.

* cited by examiner

*Primary Examiner* — T C Patel
*Assistant Examiner* — Phuongchi T Nguyen
(74) *Attorney, Agent, or Firm* — Seyfarth Shaw LLP

(57) ABSTRACT

The invention relates to a device or connecting multi-conducting plugs that can be inserted into said device in respectively opposite directions. The device of the invention includes two sockets (1, 2) for receiving the plugs, an internal multi-conducting link (3) connecting the sockets, and a housing (4*a*, 4*b*) for maintaining the sockets in opposite directions, the internal link being in the form of a ply folded into a bayonet and having on both sides of an intermediate portion (33) two end portions (31, 32) physically connected to the respective inner faces (12, 22) of the sockets (1, 2).

8 Claims, 4 Drawing Sheets

ADAPTER HAVING FLEXIBLE CABLE

CROSS-REFERENCE TO RELATED APPLICATIONS

This application is a 371 filing of International application no. PCT/FR2007/001720 filed Oct. 17, 2007.

FIELD

The invention relates in general to the field of connector technology, and, in particular, to connection accessories intended for computer applications. More precisely, the invention relates to a device for connecting between first and second plugs equipping multi-conductor cables that can be inserted into this device in respective first and second opposite directions.

Devices of this type are well-known to those skilled in the art, under the name of "crossarms", this name making reference to the fact that these devices enable the connection between plugs which are arranged, for example, on both sides of a wall.

These devices must meet numerous expectations on the part of the users thereof, and, in particular, meet difficult to reconcile a prior requirements of sturdiness, structural simplicity, compactness and user-friendliness.

In this context precisely, this invention has the purpose of proposing a connection device offering an excellent compromise in the search for these qualities.

SUMMARY

To that end, the device of the invention, which also conforms to the generic definition thereof provided in the above preamble, is substantially characterized in that it includes first and second sockets, an internal multi-conductor link, and a housing, in that the first and second sockets have respective connecting faces each bearing a plurality of contacts and designed to receive the first and second plugs, respectively, which are inserted into respective slots in the housing, and in that the first and second sockets are held in head-to-tail position in the housing, and in that the internal multi-conductor link assumes the form of a multi-conductor sheet folded into a bayonet, thereby ensuring galvanic continuity at least between each contact of each socket and a corresponding contact of the other socket, this internal link having first and second terminal portions which are physically connected to the respective internal faces of the first and second sockets, and an intermediate portion extending between the first and second terminal portions.

The internal face of each socket preferably bears a plurality of pins each of which is connected to a contact of this socket and onto which one of the internal link terminal portions is connected.

Each internal link terminal portion is advantageously rigid and is perforated with openings which are threaded on over the respective pins, the intermediate portion of the internal link, on the other hand, having the capability of being flexible.

It may also be wise to provide for the housing to be substantially formed from two shells which are assembled together and each of which bears fastening members which cooperate with the fastening members of the other one.

Ideally, the shells are identical and are assembled together head-to-tail, each shell being provided with male and female fastening members cooperating with the male and female fastening members of the other shell, respectively.

In one particular embodiment of the invention, the first and second sockets are identical to one another and can be force-fit into the respective seats in the first and second shells.

The device of the invention can further include first and second metal ground shields inserted into the respective terminal portions of the internal link and connected to one another via a conductor of this link.

This connecting device is particularly well-suited to the case wherein said sockets comply with the CEI 11 801 standard.

BRIEF DESCRIPTION OF THE DRAWINGS

Other characteristics and advantages of the invention will become apparent from the description of same, which is given hereinbelow for illustrative and non-limiting purposes, with reference to the appended drawings, in which.

DETAILED DESCRIPTION

Figure 5:
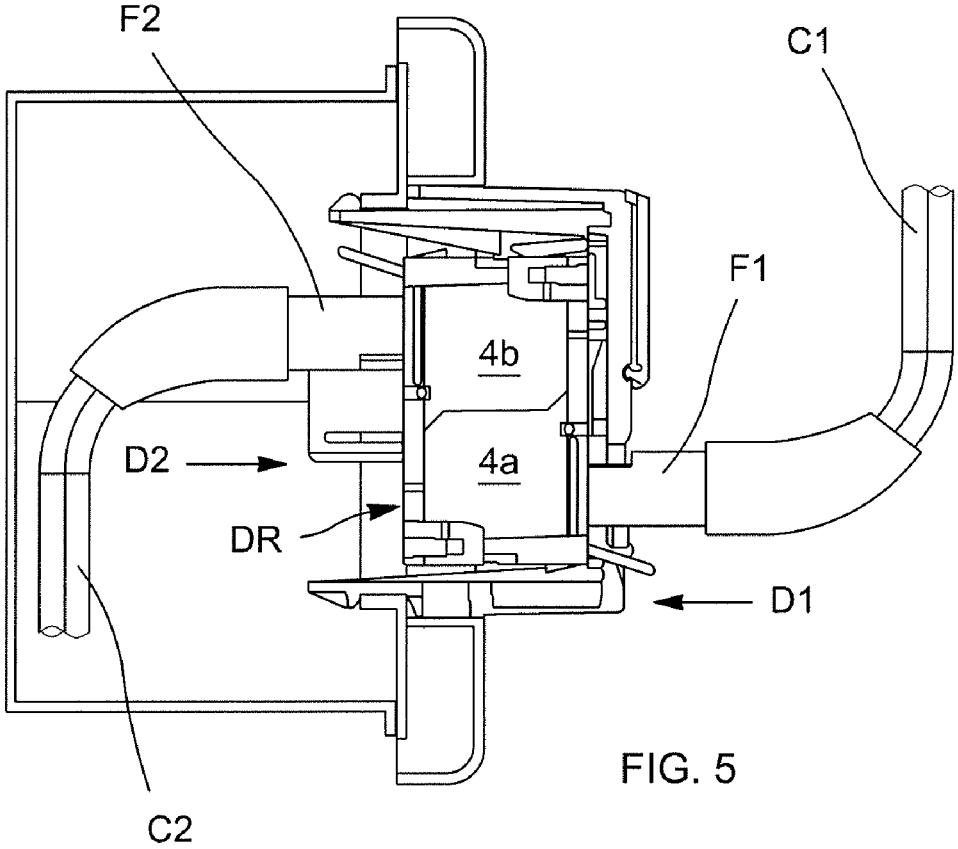
FIG. 5 is an axial section of a device as shown in FIG. 1 and completed by holding and finishing members.
Figure 6:
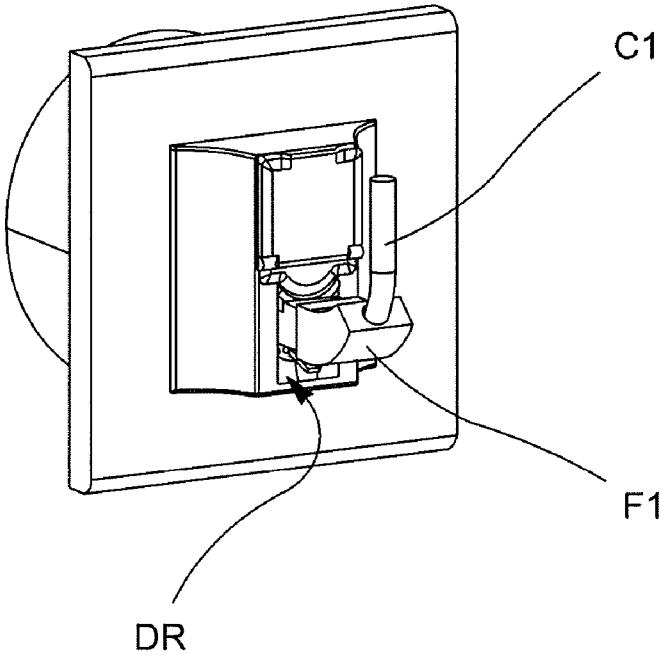
FIG. 6 is an exterior perspective view of the device shown in FIG. 5.

As indicated previously, the invention relates to a connecting device DR two plugs F1 and F2 to be connected together (FIG. 5).

These plugs equip respective multi-conductor cables C1 and C2, and are capable of being inserted into the device DR in respective opposite directions D1 and D2.

The connecting device of the invention includes substantially two sockets 1 and 2, an internal multi-conductor link 3, and a housing 4.

The housing 4 holds the sockets 1 and 2 in head-to-tail position and has slots 41 and 42 into which the plugs F1 and F2 can be inserted, respectively, in order to be connected, respectively, to the respective connecting faces 11 and 21 of the sockets 1 and 2.

Each of these connecting faces 11 and 12 bear a plurality of electrical contacts 5 each of which is placed in galvanic contact with a conductor of plug F1 or F2 when this plug is inserted into the corresponding slot 41 or 42.

The internal multi-conductor link 3 assumes the form of a multi-conductor layer folded into a bayonet and capable of ensuring galvanic continuity at least between each contact 5 of each of the sockets 1 and 2 and a corresponding contact 5 of the other socket.

This internal link 3 has two terminal portions 31 and 32 and an intermediate portion 33.

The terminal portions 31 and 32 are physically connected to the respective internal faces 12 and 22 of the sockets 1 and 2, and the intermediate portion 33 extends between the terminal portions 31 and 32 and connects them together.

Figure 1:
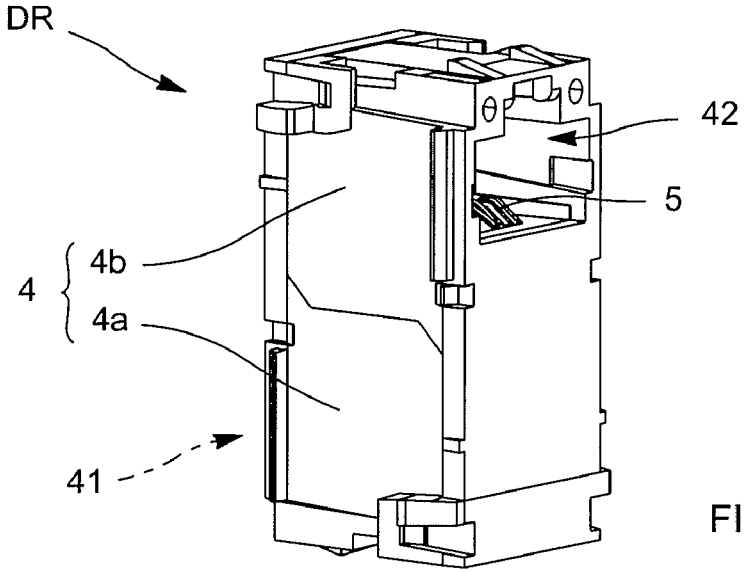
FIG. 1 is a perspective view of a connecting device in accordance with the invention.
Figure 2:
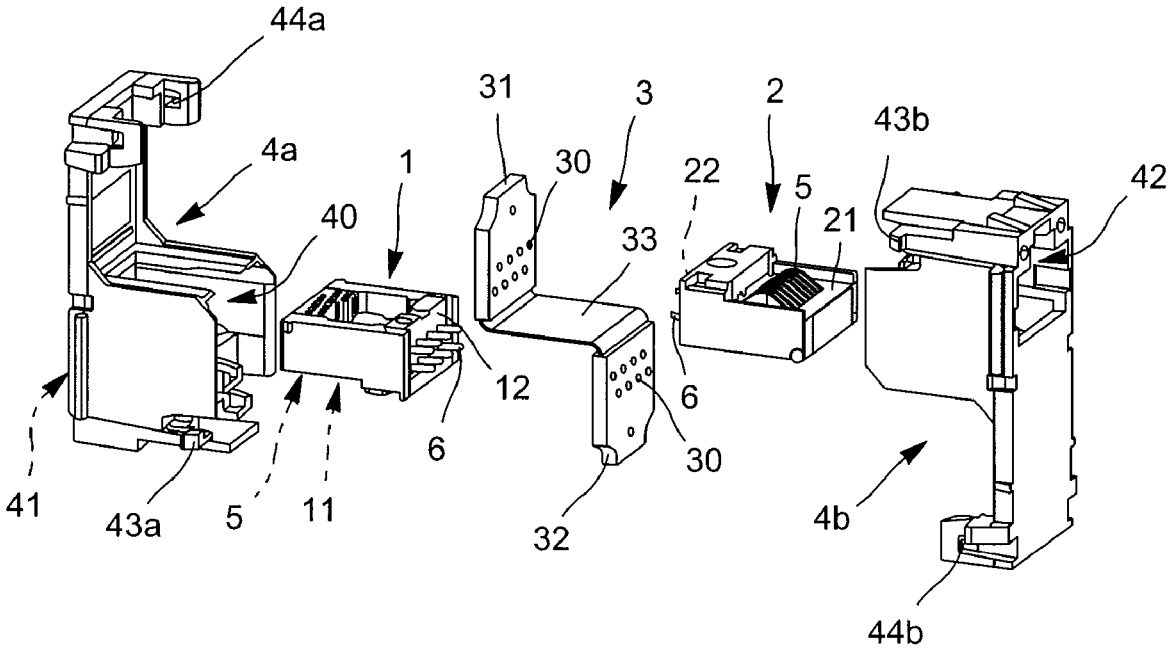
FIG. 2 is an exploded perspective view of the device shown in FIG. 1, shown at a smaller scale.
Figure 3:
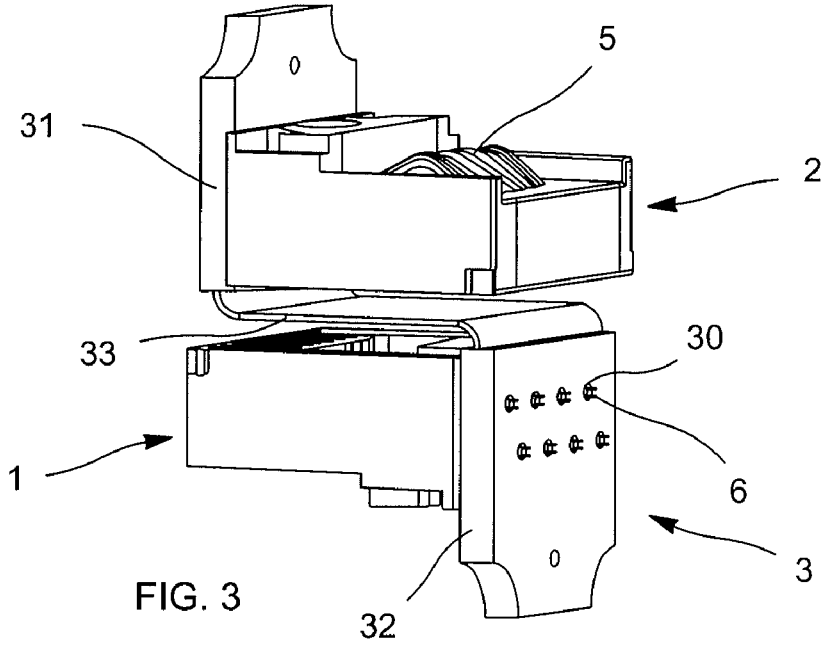
FIG. 3 is a perspective view of a sub-assembly of the device shown in FIG. 1.

As shown in FIG. 2, the internal face, such as 12 and 22, of each of the sockets 1 and 2, bears a plurality of pins 6 onto which one of the internal link 3 terminal portions 31 and 32 is connected, each of these pins 6 being connected to a contact 5 of the corresponding socket.

The internal link 3 terminal portions 31 and 32 are preferably rigid, whereas the intermediate portion 33 of this internal link is flexible, in order to be capable of being easily positioned between the sockets 1 and 2.

Furthermore, each of the internal link 3 terminal portions 31 and 32 is perforated with openings 30 each of which is in electrical contact with one of the conductors of this internal link, whereby the electrical connection between the internal link 3 and each of the sockets 1 and 2 can be easily established by threading these openings 30 over the corresponding pins 6 of this socket.

The sockets 1 and 2 are superimposed over one another in a direction perpendicular to each of directions D1 and D2, and are arranged head-to-tail on either side of the intermediate portion 33 of the internal link 3.

As also shown in FIG. 2, the housing 4 is advantageously formed from two shells 4*a* and 4*b*, which are assembled together by means of fastening members, such as 43*a*, 44*a*, 43*b* and 44*b*, which are borne by each shell and which cooperate with the fastening members of the other shell.

In a preferred embodiment, the shells 4*a* and 4*b* are identical and are assembled together head-to-tail.

Each of the shells 4*a* and 4*b* is provided with respective male fastening members 43*a* and 43*b*, as well as respective female fastening members 44*a* and 44*b*, the male and female members of each shell cooperating, respectively, with the female and male fastening members of the other shell, in order to keep the shells 4*a* and 4*b* assembled together.

The sockets 1 and 2, which can typically be identical to one another, are, for example, force-fit into the respective seats 40 in the shells 4*a* and 4*b*.

Figure 4:
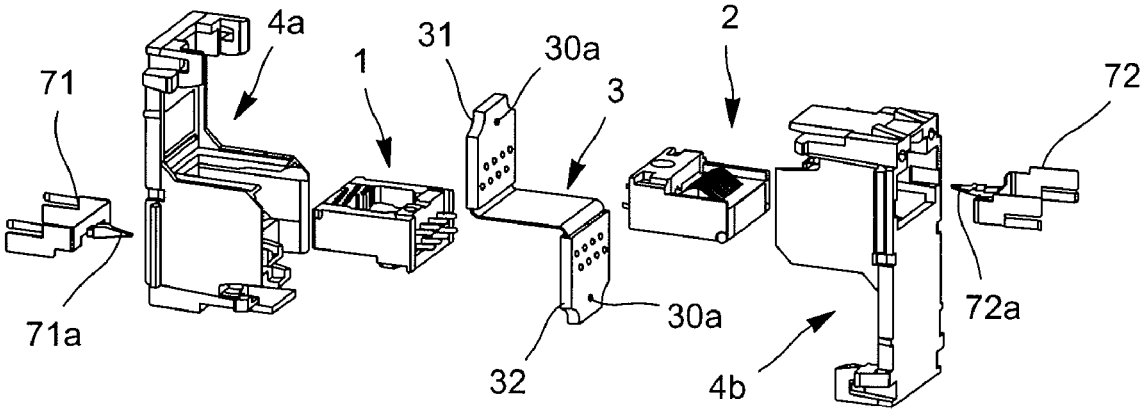
FIG. 4 is an exploded perspective view of an alternative of the device shown in FIG. 2, shown at a smaller scale.

In one particular embodiment shown in FIG. 4, the connecting device of the invention further includes two metal ground shields 71 and 72.

These shields 71 and 72 have respective pins 71*a* and 72*a* which are inserted, respectively, into dedicated openings 30*a* in the respective terminal portions 31 and 32 of the internal link 3, these shields thereby being electrically connected to one another via a conductor of this link 3.

Figure 7:
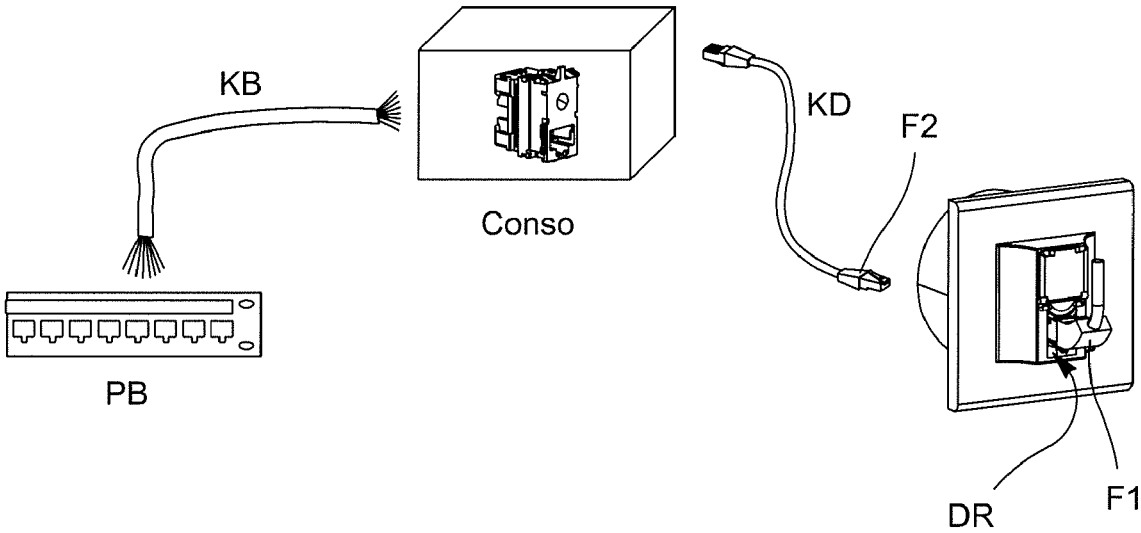
FIG. 7 is a perspective view showing the application context of one particular embodiment of the device of the invention.

FIG. 7 shows the typical application conditions of the connecting device DR of the invention, in the case wherein the sockets 1 and 2 are computer sockets compliant with the CEI 11 801 standard.

As shown in this figure, this device DR enables a plug F1 to be connected to a consolidation point CONSO by means of a cord KD equipped with a plug F2, this consolidation point CONSO itself having the capability of being connected to a patch panel PB by means of a multi-conductor cable KB which is optionally installed permanently.

The invention claimed is:

1. Device for connecting between first and second plugs (F1, F2) equipping multi-conductor cables (C1, C2) that can be inserted into this device in respective first and second opposite directions (D1, D2), characterized in that it includes first and second sockets (1, 2), an internal multi-conductor link (3), and a housing (4), in that the first and second sockets (1, 2) have respective connecting faces (11, 21) each bearing a plurality of contacts (5) and designed to receive the first and second plugs (F1, F2), respectively, which are inserted into respective slots (41, 42) in the housing (4), and in that the first and second sockets (1, 2) are held in head-to-tail position in the housing (4), in that the internal multi-conductor link (3) assumes the form of a multi-conductor sheet folded into a bayonet, thereby ensuring galvanic continuity at least between each contact (5) of each socket (1, 2) and a corresponding contact (5) of the other socket (2, 1), this internal link (3) having first and second terminal portions (31, 32) which are physically connected to the respective internal faces (12, 22) of the first and second sockets (1, 2), and an intermediate portion (33) extending between the first and second terminal portions (31, 32), in that the internal face (12, 22) of each socket (1, 2) bears a plurality of pins (6) each of which is connected to a contact (5) of this socket (1, 2) and onto which one of the internal link (3) terminal portions (31, 32) is connected, and in that each internal link (3) terminal portion (31, 32) is rigid and is perforated with openings (30) which are threaded on over the respective pins (6).

2. Connecting device of claim 1, characterized in that the internal link (3) intermediate portion (33) is flexible.

3. Connecting device of claim 1, characterized in that it further includes first and second metal ground shields (71, 72) which are inserted into the respective internal link (3) terminal portions (31, 32) and which are connected together via a conductor of this link (3).

4. Connecting device of claim 1, characterized in that said sockets (1, 2) are compliant with the CEI 11 801 standard.

5. Connecting device of claim 1, characterized in that the housing (4) is substantially formed from two shells (4*a*, 4*b*) which are assembled together and each of which bears fastening members (43*a*, 44*a*, 43*b*, 44*b*) which cooperate with the fastening members of the other one.

6. Connecting device of claim 5, characterized in that the shells (4*a*, 4*b*) are identical and are assembled together head-to-tail, each shell (4*a*, 4*b*) being provided with male (43*a*, 43*b*) and female (44*a*, 44*b*) fastening members cooperating with the male (43*b*, 43*a*) and female (44*b*, 44*a*) fastening members of the other shell (4*b*, 4*a*), respectively.

7. Connecting device of claim 1 , characterized in that the first and second sockets (1, 2) arc identical to one another.

8. Connecting device of claim 6, characterized in that the first and second sockets (1, 2) are force-fit into respective seats (40) in the first and second shells (4a, 4*b*).

* * * * *